United States Patent [19]

Haydu

[11] Patent Number: 4,771,868

[45] Date of Patent: Sep. 20, 1988

[54] HANDBRAKE MECHANISM FOR SINGLE-CYLINDER, TRUCK-MOUNTED RAILWAY CAR BRAKE ASSEMBLY

[75] Inventor: Andrew G. Haydu, Pittsburgh, Pa.

[73] Assignee: American Standard Inc., Wilmerding, Pa.

[21] Appl. No.: 939,993

[22] Filed: Dec. 10, 1986

[51] Int. Cl.[4] ..... B61H 13/02; B61H 13/24

[52] U.S. Cl. ..... 188/52; 403/57; 403/157

[58] Field of Search ..... 188/52, 53, 54, 55, 188/56, 49, 50, 57, 33; 403/157, 57, 58, 74, 79

[56] References Cited

U.S. PATENT DOCUMENTS

| | | | |
|---|---|---|---|
| 2,049,163 | 7/1936 | Hufferd | 403/57 |
| 2,833,377 | 5/1958 | Holin | 188/33 |
| 3,298,474 | 1/1967 | Roselius et al. | 188/52 X |
| 3,378,108 | 4/1968 | McClure et al. | 188/52 |
| 3,731,766 | 5/1973 | Campbell | 188/52 |
| 3,857,642 | 12/1974 | Miller | 403/57 |
| 4,613,016 | 9/1986 | Hart et al. | 188/52 |

FOREIGN PATENT DOCUMENTS

| | | | |
|---|---|---|---|
| 1220903 | 1/1971 | United Kingdom | 403/58 |

*Primary Examiner*—George E. A. Halvosa
*Attorney, Agent, or Firm*—G. J. Falce

[57] ABSTRACT

A handbrake arrangement for a single cylinder, truck-mounted, railway car brake assembly comprising a lever system mounted on the body of the single brake cylinder, which is, in turn, mounted on one of a pair of truck brake beams. The lever system is connected to the handbrake chain, so that operation of the handwheel effects relative movement between the brake cylinder body and brake cylinder push rod. This results in the truck brake beams being spread apart into braking position in the same manner as occurs during a pneumatic brake application, via the respective brake beam, transfer levers and force-transmitting connecting rods that extend between the brake beams.

10 Claims, 4 Drawing Sheets

HANDBRAKE MECHANISM FOR SINGLE-CYLINDER, TRUCK-MOUNTED RAILWAY CAR BRAKE ASSEMBLY

BACKGROUND OF THE INVENTION

The present invention relates to railway car brake rigging comprising a single-cylinder, truck-mounted, brake assembly in which lightweight, truss-type brake beams are employed and, more particularly, to a handbrake adapted to such a brake rigging.

A brake rigging of the aforementioned type is disclosed in U.S. patent application Ser. No. 764,047, now U.S. Pat. No. 4,613,016, assigned to the assignee of the present application. In order to utilize the lightweight, truss-type brake beams, it is imperative that the rigging configuration be such that the braking forces are applied at the midpoint of the brake beams, since at this location the bending load on the beam compression member is transmitted to the beam tension member via a strut rod, in order to support the bending stresses on the beam. Thus, in adapting a handbrake to a brake rigging of the aforementioned typed, the handbrake mechanism must interact with the brake rigging such that the handbrake force is also applied at the beam midpoint.

SUMMARY OF THE INVENTION

It is an object of the present invention, therefore, to provide a handbrake arrangement for use with a single-cylinder, truck-mounted brake assembly of the above-discussed type, wherein the handbrake force is applied at the midpoint of the cooperating brake beams of the brake assembly.

It is a further object of this invention to provide a handbrake arrangemenet in accordance with the foregoing objective, wherein the handbrake rigging is affixed to only a single brake beam, in order to provide a simple, low-cost, interference-free arrangement by the absence of force-transmitting rods between the respective brake beams of a brake assembly.

In achieving the foregoing objectives, the single brake cylinder of the aforementioned brake assembly is connected at its non-pressure head to one end of a live handbrake actuator lever, and it is connected at its piston rod to a corresponding end of a dead actuator lever that is substantially parallel with the first-mentioned actuator lever. The opposite ends of the respective live and dead actuator levers are connected to the handbrake chain and to an anchor rod fixed to the bolster. Another link is pivotally-connected between the live and dead actuator levers at a location intermediate the ends thereof.

The single brake cylinder is mounted with the body on the compression member of one truss-type brake beam adjacent a strut bar that interconnects the beam tension and compression members at their midpoints. Pivotally-connected to the strut bar is a transfer lever, one end of which is connected to the brake cylinder piston rod together with the live handbrake actuator lever, and the other end of which is connected by a first force-transmitting member to the corresponding end of a pivotally-mounted transfer lever of another truss-type brake beam of the brake assembly. This other brake beam is basically similar to the one brake beam, except for the absence of a brake cylinder. A second force-transmitting member is connected between the one end of the other beam transfer lever and the one brake beam at a location where the single brake cylinder is mounted thereto.

The brake rigging acts to force the respective brake beams apart, into brake shoe/wheel engagement, when either the service brake or the handbrake is applied. It will be appreciated, therefore, that the application of a handbrake with a brake rigging specifically adapted to apply the service braking force at the beam midpoint also applies the handbrake force at the beam midpoint, so as to make the handbrake compatible with low-cost, truss-type brake beams.

BRIEF DESCRIPTION OF THE DRAWINGS

The foregoing objects and attendant advantages of this invention will become apparent from the following more detailed explanation, when taken inconjunction with the accompanying drawings, in which.

DESCRIPTION AND OPERATION

Figure 1:
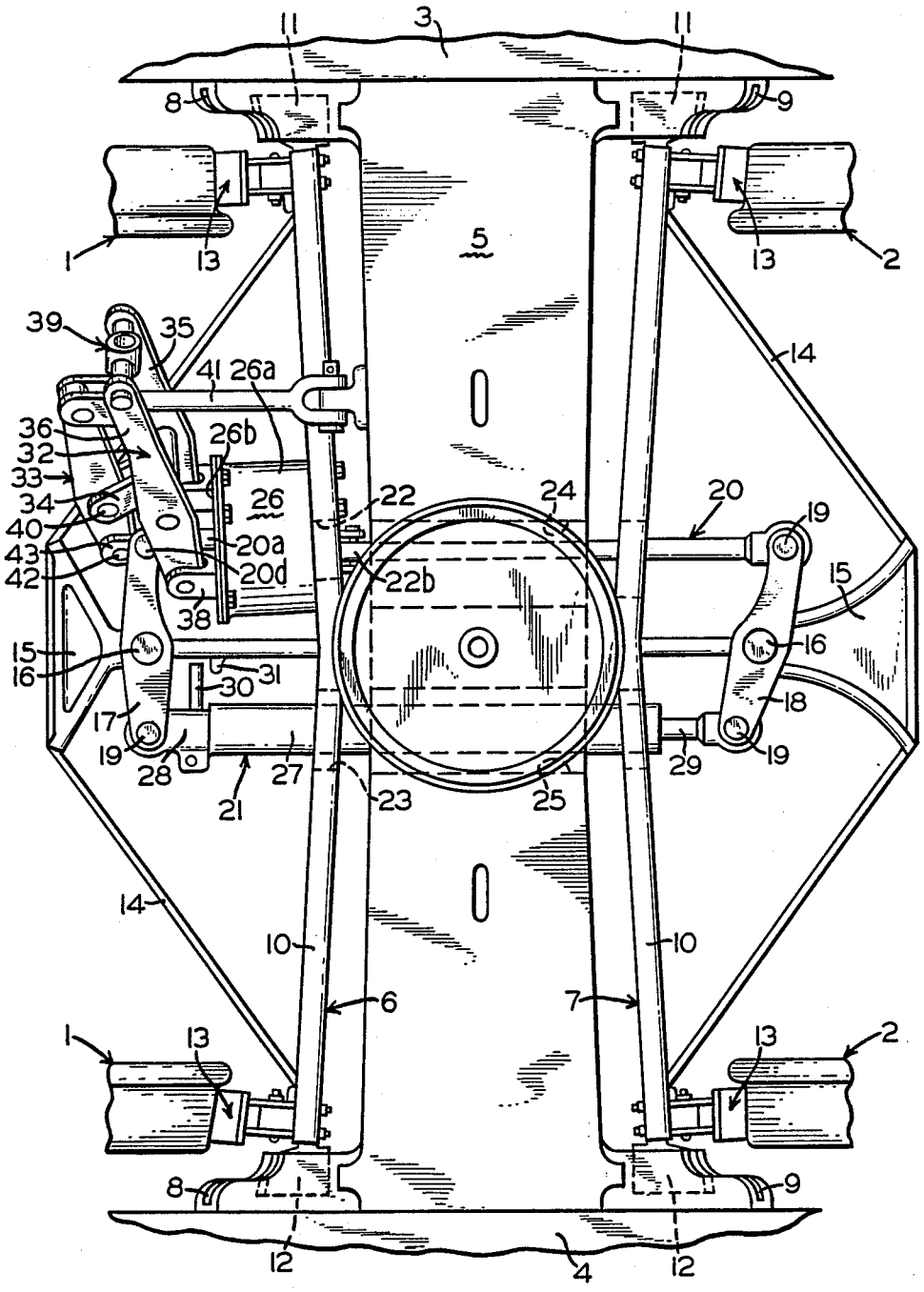
FIG. 1 is a top assembly view of a railway car truck, equipped with a truck-mounted brake assembly in which but a single brake cylinder is employed, and including a handbrake arrangemenet specifically adapted to such a rigging in accordance with the present invention.

Referring to FIG. 1 of the drawings, a railway car truck is shown comprising a pair of wheel sets 1 and 2, a pair of side frames 3 and 4 supported on the wheel sets by journal bearings (not shown) in a conventional, well-known manner, and a bolster 5 that is spring-supported at its ends on the respective side frames. A pair of parallel brake beams 6 and 7 are spaced-apart on opposite sides of bolster 5, and extend laterally between the side frames, with their ends being supported in guide pockets 8 and 9 formed in the truck side frames.

Brake beams 6 and 7 are similar in construction, each including a U-shaped compression member 10 that extends laterally between the side frames with guide feet 11 and 12 fixed in a suitable manner to the ends of compression member 10, so as to ride in pockets 8 and 9 and thereby guidably-support the brake beams at the proper height above the rails and somewhat below the axle of a wheel set. Also fixed to the brake beam near the ends of compression member 10 adjacent the wheel treads (in a well-known, conventional manner) is a removable brake head and brake shoe assembly 13. Guide pockets 8 and 9 are formed in the truck side frames at a slight angle with the horizontal, so that the motion of the brake beam during a brake application brings the brake shoes radially into engagement with the wheel treads.

Also fixed to each end of the brake beam compression member is a laterally-extending tension member 14, the center of which is rigidly-connected to the midpoint of compression member 10 by a strut bar 15. As is well-known in the railway braking art, truss-type brake beams, such as brake beams 6 and 7, are capable of supporting relatively high bending forces by reason of the stress in tension member 14 increasing as compression member 10 tends to bend. Consequently, brake beams 6 and 7, while being made of relatively lightweight construction, are sufficiently strong to withstand the force of braking transmitted to brake head and brake shoe assembly 13 via the brake beams.

Figure 3:
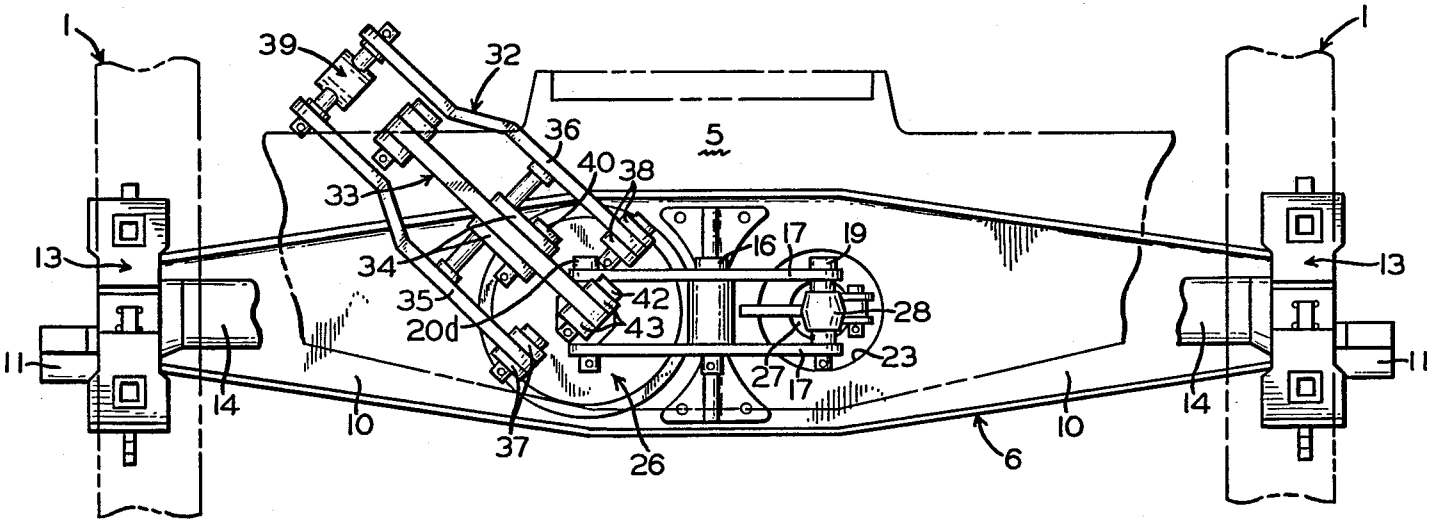
FIG. 3 is an assembly view, showing the front elevation of the brake assembly, including the handbrake of the present invention.
Figure 4:
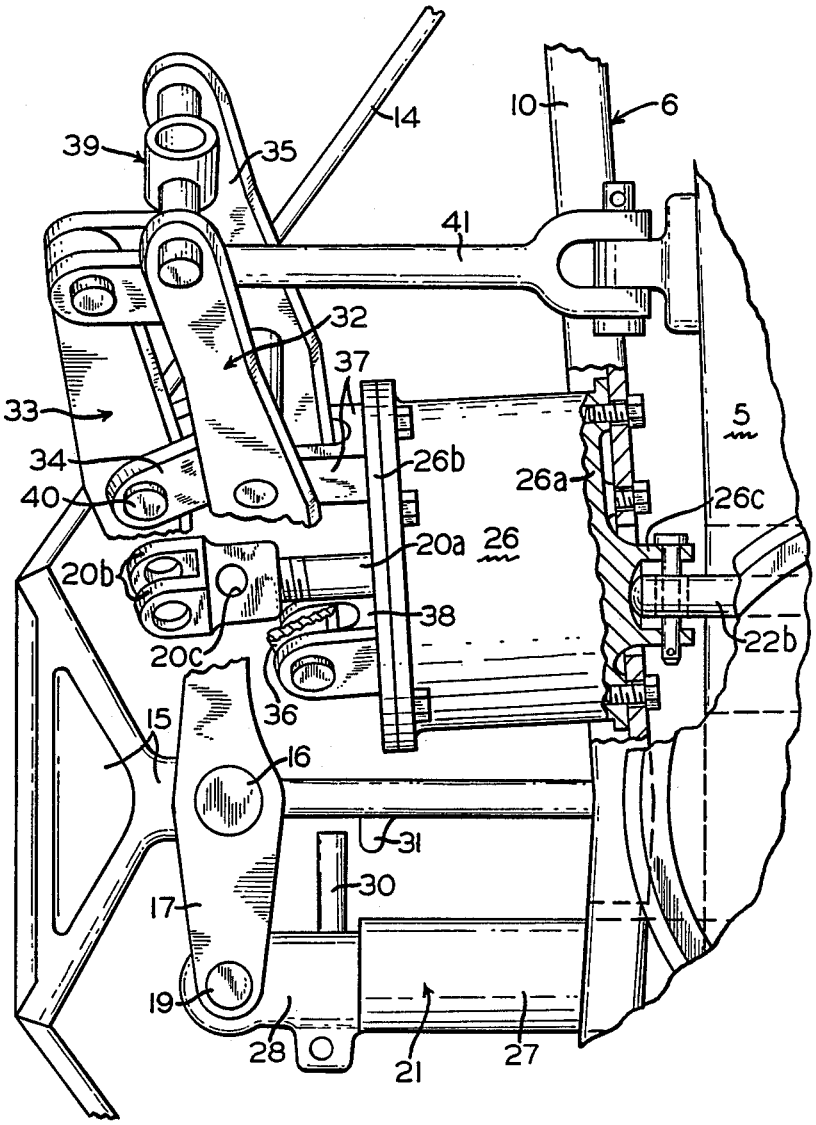
FIG. 4 is an enlarged fragmentary view showing the handbrake arrangement, portions of which are broken away to better illustrate the piston push rod connection with the dead handbrake lever and with the brake beam transfer lever.

Pivotally-connected by a pin 16 to strut bar 15 of the respective brake beams 6 and 7 are identical, bifurcated, transfer levers 17 and 18, as shown in FIG. 3. Connected by pins 19 to corresponding ends of the respective transfer levers 17 and 18, so as to lie in a substantially horizontal plane, are force-transmitting members 20 and 21 which pass through openings 22 and 23 provided in the compression member 10 of each brake beam and through standard openings 24 and 25 in bolster 5. An actuator device, such as a conventional, piston-type brake cylinder 26, includes a pressure head **26*a* and a non-pressure head 26*b*. Brake cylinder 26 is suitably-mounted to one brake beam 6 by being bolted or otherwise secured to the base of the U-shaped compression member 10, at a location between the compression and tension members and in alignment with opening 22 in compression member 10 of beam 6. Brake cylinder 26 further includes a piston (not shown), and a piston push rod 20*a*, which, together with connecting rod 22*b*, comprises force-transmitting member 20. Push rod 20*a* is formed with clevis lugs 20*b* and a through opening 20*c*, as shown in FIG. 4. A pin 20*d* passes through an opening in transfer lever 17 and opening 20*c* to pivotally-connect push rod 20*a* and transfer lever 17 together, while rod 22*b* is connected between pressure head 26*a* and transfer lever 18**.

A connecting lug **26*c* projects from the brake cylinder pressure head 26*a* and passes through an opening in the compression member 10 of brake beam 6 for engagment with the end of connecting rod 22*b*. Lug 26*c* is formed with a spherical base, against which a simiarly-shaped end of connecting rod 22*b* bears to transmit force from transfer lever 18 to beam 6. Such an arrangement acommodates relative vertical and lateral movement of the respective brake beams and associated links without binding at the connection of rod 22*b* with brake cylinder 26**.

In accordance with the foregoing, it will be appreciated that all the aforementioned parts of the brake rigging lie in the horizontal plane in which the force-transmitting members 20 and 21 lie, and that this horizontal plane rises and falls as brake applications are made and released, due to the angle of inclination of guide pockets 8 and 9 in which guide feet 11 and 12 operate.

The respective arms of transfer levers 17 and 18 may be equal in length or, as shown in the present arrangement, of unequal length in order primarily to provide the mechanical advantage necessary to achieve the desired brake forces.

It will be further appreciated that in making the one arm of transfer levers 17 and 18 longer than the other arm, it is possible to use a larger diameter brake cylinder 26 without the cylinder body interfering with strut bar 15.

Force-transmitting member 21 may be a single-force transmitting rod or, as shown here, a double-acting slack adjuster device 27, such as the slack adjuster device disclosed in copending U.S. application Ser. No. 714,596, assigned to the assignee of the present invention. One end 28 of the slack adjuster housing is connected to transfer lever 17, while the opposite end 29 associated with an extendable rod of the slack adjuster, that is axially-movable relative to the slack adjuster housing, is connected to transfer lever 18.

A trigger arm 30 is pivotally-connected to the slack adjuster housing at its outboard side and passes laterally through openings (not shown) in the slack adjuster housing into proximal engagement with a lug 31 on strut bar 15 of brake beam 6. The trigger arm thus rotates with relative movement between the brake beam 6 and force-transmitting memeber 21, as a means of detecting excessive travel of brake cylinder push rod **20*a*** due to brake shoe/wheel wear.

Figure 2:
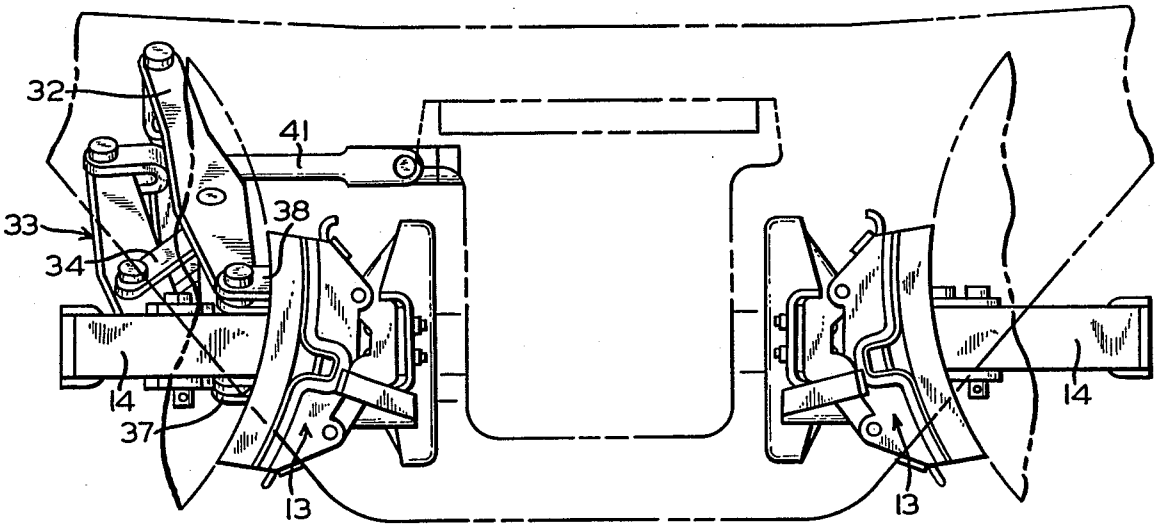
FIG. 2 is an assembly view showing the side elevation of the brake assembly, including the handbrake of the present invention.

Cooperatively-arranged with the above-described brake rigging is a handbrake mechanism comprising a live brake actuating lever 32, a dead lever 33 arranged substantially parallel with live lever 32, and a pivotal link 34 that interconnects the live and dead levers intermediate the ends thereof. Live lever 32 consists of a pair of spaced-apart arms 35 and 36 that are pivotally-fixed at one end to bifurcated mounting brackets 37 and 38 formed on the non-pressure head **26*b* of brake cylinder 26. These mounting brackets are spaced on opposite sides of the brake cylinder push rod 20*a*, at an angle with the horizontal, as clearly shown in FIG. 2, in order to angularly-dispose the handbrake mechanism so as to operate without interference with the car underbody (not shown). The free end of live lever 32 is provided ith a swivel connection 39** to recieve the handbrake chain (not shown).

The pivotal link 34 that connects dead lever 33 to live lever 32 is bifurcated, being pivotally-connected at its closed end to the live lever 32 within the space between the two arms 35 and 36. Dead lever 33 is a single member that is pivotally-connected by a pin 40 to pivotal link 34 within the bifurcation thereof. The upper end of dead lever 33 is pivotally-connected to bolster 5 by a tie rod 41, while the lower end of dead lever 33 is pivotally-connected by a pin 42 to a clevis 43 that projects from the end of brake cylinder push rod **20*a***.

The brake rigging, according to the present arrangment, operates in response to the supply and release of compressed air to brake cylinder 26, or in response to operation of the handbrake mechanism. Having its fixed end secured to the left-hand side of the compression member 10 of brake beam 6, brake cylinder 26 responds to the supply of compressed air by axial movement of piston push rod **20*a* away from the fixed end of brake cylinder 26**.

Similarly, rotation of live lever 32 is a couterclockwise direction above its fixed connection with mounting brackets 37 and 38 of brake cylinder 26, when the handbrake chain is taken up, acts through pivotal link 34 to effect clockwise rotation of dead lever 33 about its connection with tie rod 41. Accordingly, pistion push rod **20*a* is pulled out of brake cylinder 26 by its conenction with the lower end of dead lever 33**.

Being connected to transfer lever 17, push rod **20*a* of force-transmitting member 20 effects rotation of transfer lever 17 about pivot pin 16 in a counterclockwise direction, with either the supply of compressed air to brake cylinder 26 or by operation of the handbrake mechanism. This couterclockwise rotation of transfer lever 17 results in force-transmitting member 21 being moved in the direction of the right-hand to, in turn, effect couterclockwise rotation of transfer lever 18 about its pivot pin 16. In that connecting rod 22*b* of force-transmitting member 20 abuts the pressure head of the brake cylinder 26, resistance to movement is encountered at the end of transfer lever 18 connected to connecting rod 22b by pin 19, so that transfer lever 18 acts as a second-class lever. Thus, the force exerted at the other end of transfer lever 18 by force-transmitting member 21 causes transfer lever 18 to pivot in a counterclockwise direction about its pin 19 to thereby move brake beam 7 in the direction of the right-hand through the connection of transfer lever 18 with strut bar 15, bringing the brake shoes of brake head and brake show assemblies 13 associated with brake beam 7 into engagement with the wheel treads of wheel set 2**.

Once brake shoe engagement occurs at brake beam 7, the connection of transfer lever 17 with force-transmitting member 21 at its pin 19 becomes solid and transfer lever 17 also becomes a second-class lever. Thus, continued movement of piston push rod 20a out of brake cylinder 26 causes the counterclockwise rotation of transfer lever 17 to take place by pivotal rotation about the pin connection 19 of transfer lever 17 with force-transmitting member 21. Accordingly, the applied handbrake force acts through pin 16 of transfer lever 17 and strut bar 15 to force brake beam 6 in the direction of the left-hand, while concurrently, the right-hand force acting on beam 6 through pressure head 26a of cylinder 26 is counteracted by the left-hand force exerted on beam 6 through transfer lever 17, force-transmitting member 21, transfer lever 18, and force-connecting rod 22b thereby bringing the brake shoes of brake head and brake shoe assemblies 13 associated with brake beam 6 into engagement with the wheel treads of wheel set 1.

In that slack adjuster device 27 has been previously disclosed in copending application, Ser. No. 714,596, now U.S. Pat. No. 4,662,485, it should suffice to say here that, during a brake application, (according to the foregoing explanation) slack adjuster device 27 is capable of supporting the compressive forces exerted on force-transmitting member 21, of which slack adjuster 27 is an integral part by means of trigger arm 30 engaging lug 31 to lock up the slack adjuster. It should also be noted that, in the event brake shoe wear occurs during the aforementioned brake application, engagement of trigger arm 30 of the slack adjuster device 27 with lug 31 on the strut bar 15 will initiate the adjuster action in an amount corresponding to the degree of brake shoe wear. Completion of the brake application rotates the trigger arm in a couterclockwise direction about it pivotal connection with the slack adjuster housing to the lock-up position, enabling the compressive braking forces to be developed.

When the brake application is released, the compressed air effective in brake cylinder 26 is exhausted, allowing the respective brake beams to be moved by the force of gravity and by the brake cylinder release spring (not shown) down the inclined guide pockets 8 and 9, toward a retracted position in which the brake shoes of the respective brake head and brake shoe assemblies are maintained a predetermined distance apart from the associated wheel tread braking surface. During the initial release movement, slack adjuster device 27 reacts to the actuated trigger arm 30, indicative of the brake shoe wear that occurred while the brakes were being applied during a previous brake application and to extend the slack adjuster until the trigger arm 30 is pivoted out of engagement with lug 31. When this occurs, sufficient slack will have been taken up to compensate for the brake shoe wear and the slack adjuster will now lock-up, so as to support the force exerted through the rigging as the brake beams continue to be retracted with the exhaust of brake pressure from brake cylinder 26. This retraction of the brake beams to move the brake shoes out of engagement with the wheel treads results in movement of the transfer levers 17 and 18, and force-transmitting members 20 and 21, as well as brake beams 6 and 7, in a manner opposite to that occurring during application of the brakes.

It will be appreciated that, by affixing the one side of brake cylinder 26 to brake beam 6 to compression member 10 and having the slack adjuster trigger arm 30 sense lug 31 on the brake beam strut bar, the relationship between the trigger arm and the shoe-wear reference point provided by lug 31 remains constant for any given position of the brake beams, thereby assuring an accurate reading of brake shoe wear and consequent slack take-up by the slack adjuster operation.

In addition, the fact that the handbrake force acts through the brake rigging the same way as does the brake cylinder application force, the braking force in each instance is applied at the midpoint of the respective beams, that is, at the truss member 15 thereof, in keeping with the desire to utilize conventional, low-cost type brake beams.

I claim:

1. A handbrake arrangement for a railway car truck having a pair of wheel sets comprising:

(a) substantially parallel, spaced-apart brake beams interposed between said pair of wheel sets and having brake shoes carried thereon adjacent the respective wheel treads of said wheel sets for engagement therewith when said brake beams are moved apart;

(b) first and second force transfer levers, each being pivotally-connected at a point intermediate the ends thereof to a respective one of said brake beams at the beam midpoint, said first and second force transfer levers each forming on opposite sides of said pivotal connection point thereof one arm and another arm;

(c) a brake actuator comprising:

(i) a brake cylinder body; and (ii) a piston push rod projecting from said brake cylinder body and connected to said one arm of said first transfer lever, whereby axial displacement of said piston push rod relative to said brake cylinder body effects rotation of said first transfer lever;

(d) a live handbrake lever having one end pivotally-connected to said brake cylinder body and the other end free;

(e) a dead handbrake lever having one end connected to said piston push rod and the other end fixed, said live and dead levers being pivotally-connected together at a location intermediate the ends thereof, whereby rotation of said live handbrake lever in one direction about said one end thereof in response to a handbrake application force being applied at said other end of said live handbrake lever provides rotation of said dead handbrake lever about said other end thereof in a direction opposite said one direction to thereby effect said axial displacement of said piston push rod relative to said brake cylinder body;

(f) a connecting rod having one end connected to said one arm of said second force transfer lever and the other end abutting said brake cylinder body; and (g) force-transmitting means connected between the other arms of said first and second transfer levers for effecting rotation of said second transfer lever in response to said rotation of said first transfer lever, whereby said first and second brake beams are forced apart to effect said engagment of said brake shoes with said wheel treads of said wheel sets with a force corresponding to said applied handbrake application force.

2. A handbrake arrangement, as recited in claim 1, wherein said brake cylinder body comprise a pressure head and a non-pressure head, said brake cylinder body being connectd to said first brake beam at said pressure head thereof.

3. A handbrake arrangement, as recited in claim 2, wherein said other end of said connecting rod is spherical in shape, and said pressure head is formed with a spherical cavity with which said spherical-shaped end of said connecting rod has abutting engagement.

4. A handbrake arrangement, as recited in claim 2, wherein said one end of said live handbrake lever is pivotally-connected to said non-pressure head of said brake cylinder body.

5. A handbrake arrangment, as recited in claim 4, wherein said live handbrake lever is pivotally-connected to said non-pressure head so as to operate in a plane that lies at an angle with the horizontal.

6. A handbrake arrangement, as recited in claim 5, wherein said live handbrake lever comprises a pair of spaced-apart arms that lie on opposite sides of said push rod, each said arm being pivotally-connected to said non-pressure head.

7. A handbrake arrangement, as recited in claim 4, wherein said one end of said dead lever and said one end of said first transfer lever are pivotally-connected to said piston push rod.

8. A handbrake arrangement, as recited in claim 1, further comprising a tie rod pivotally-connected at one end to said railway car truck and at the other end to said other end of said dead lever.

9. A handbrake arrangment, as recited in claim 8, wherein said tie rod lies between said spaced-apart arms of said live lever.

10. A handbrake arrangment, as recited in claim 1, further comprising a pivotal link connected between said live and dead levers to provide said pivotal connection therebetween.

* * * * *